US006102342A

United States Patent [19]

Dunn

[11] Patent Number: 6,102,342

[45] Date of Patent: Aug. 15, 2000

[54] HOSE NOZZLE SUPPORT

[76] Inventor: George A. Dunn, 267 Wyckoff Rd., Eatontown, N.J. 07724

[21] Appl. No.: 09/287,422

[22] Filed: Apr. 7, 1999

[51] Int. Cl.[7] ..... A47G 29/00

[52] U.S. Cl. ..... 248/83; 248/174; 248/75

[58] Field of Search ..... 248/83, 80, 79, 248/75, 78, 150, 152, 165, 49, 174

[56] References Cited

U.S. PATENT DOCUMENTS

| | | | |
|---|---|---|---|
| 2,798,393 | 7/1957 | Currin | 248/153 |
| 2,846,168 | 8/1958 | Schroeter | 248/49 |
| 3,021,102 | 2/1962 | Kuempel | 248/49 |
| 3,843,110 | 10/1974 | Smith | 248/49 X |
| 4,403,758 | 9/1983 | Burt | 248/49 |
| 4,513,934 | 4/1985 | Pruyne | 248/49 |
| 5,839,702 | 11/1998 | Jette | 248/49 |

*Primary Examiner*—Ramon O. Ramirez
*Assistant Examiner*—Gwendolyn Baxter
*Attorney, Agent, or Firm*—Robert M. Skolnik

[57] ABSTRACT

A unitary structure for supporting a hose nozzle has an angled support surface formed between two generally vertical walls. The walls are attached to the ends of two legs at an angle of approximately 30° so that the legs intersect the ground at an angle of approximately 60° for stability.

9 Claims, 3 Drawing Sheets

HOSE NOZZLE SUPPORT

BACKGROUND OF THE INVENTION

1. Field of the Invention

The present invention relates to a garden hose nozzle support. The support of the present invention is a one-piece structure with spring compression on the hose nozzle and an angled surface to support a portion of the nozzle and a portion of the hose to which it is connected.

2. Description of the Related Art

Hose nozzle supports are taught in several prior art patents.

Edwards, U.S. Pat. No. 169,344 shows a hose nozzle support with a pivoting head on the top of a stake. The nozzle support includes special fixtures for holding the nozzle and locking it in place.

Gibbs, U.S. Pat. No. 684,220, discloses a nozzle support with a supporting base.

Gibbs, U.S. Pat. No. 911,716, is a lawn sprinkler with a two legged stand.

Hill, U.S. Pat. No. 1,502,822 discloses a special spray nozzle having two legs and an adjustable deflection plate. The end of the hose is attached to the nozzle.

Edgerton, U.S. Pat. No. 3,473,770 is a four-legged flanged stake with a spring clamp attached to the top of the stake.

Winkler, et al. U.S. Pat. No. 4,135,555, discloses a mounting stake with a special head for a flat soaker hose. Different mechanical structures are shown for angling the hose relative to the vertical.

Lemkin, et al, U.S. Pat. No. 4,850,555 shows a special purpose connector for an irrigation device. The connector is mounted on a stake.

Olson, U.S. Pat. No. 4,944,476, FIGS. 4–6 shows a hose support with stake having notches cut in the legs of the stake support.

Johnston, Des. 263,903, Lemkin, et al, Des. 285,409 and Walters, Des. 343,552 disclose stake support hose holders.

SUMMARY OF THE INVENTION

During landscaping, for example, there are many occasions when the use of regular lawn sprinklers is not desirable. These include wetting down small areas such as a newly planted tree, a burnt area of grass, or a flowerbed. Further, the experience of having to turn off the hose, unscrew the nozzle, screw on a sprinkler, then return to the water source and turn on the hose is tedious and time consuming. Further frustrations occur if there are leaks at the connections of the nozzle, the sprinkler, or both.

The present invention solves these problems and frustrations by providing an efficient support for a regular garden hose and nozzle so that the supported hose can serve as a lawn and garden sprinkler.

A principal object and advantage of the invention is the provision of a hose nozzle support so that the hose can serve as a sprinkler or a soaker.

Another object and advantage of the invention is the provision of a hose nozzle support that is constructed as a one-piece article.

A still further object of the invention is the provision of a one-piece hose support where the nozzle is held in place by compression of portions of the support.

Another object and advantage of the invention is the provision of hose nozzle support having an angled surface for supporting the nozzle and/or a portion of the hose in proximity to the nozzle so that the water spray is directed upwardly at an angle with respect to the horizontal.

A still further object and advantage of the invention is the provision of a hose nozzle support where compressive forced on the hose nozzle hold the nozzle in position on the angled surface.

A still further object and advantage of the invention is the provision of a one-piece hose nozzle support where the sides of the support also serve as its legs.

The foregoing, as well as further objects and advantages of the invention will become apparent to those skilled in the art from a review of the following detailed description of my invention, reference being made to the accompanying drawings.

DETAILED DESCRIPTION OF THE PREFERRED EMBODIMENT

Figure 1:
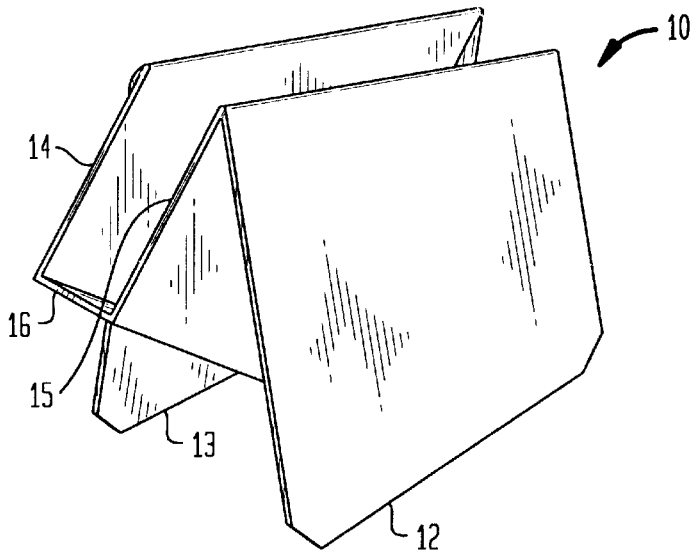
FIG. 1 is perspective view of my invention.
Figure 2:
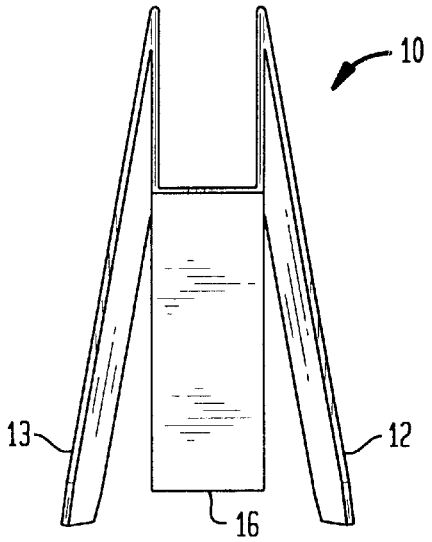
FIG. 2 is a front view of the device shown in FIG. 1.

As shown in FIGS. 1–6, where like reference numerals are used to designate like parts, the hose support is shown generally at numeral 10. Support 10 is formed of as a unitary one-piece structure having two legs 12 and 13, which extend upwardly and an angle of 30°±2° with respect to the vertical. The corners of legs 12 and 13 are beveled. The bevels for the leg 12 are shown at numerals 17 and 18. The bevels for the leg 13 are shown at 19 and 20, FIG. 7. The bevels eliminate sharp corners on the legs.

Figure 3:
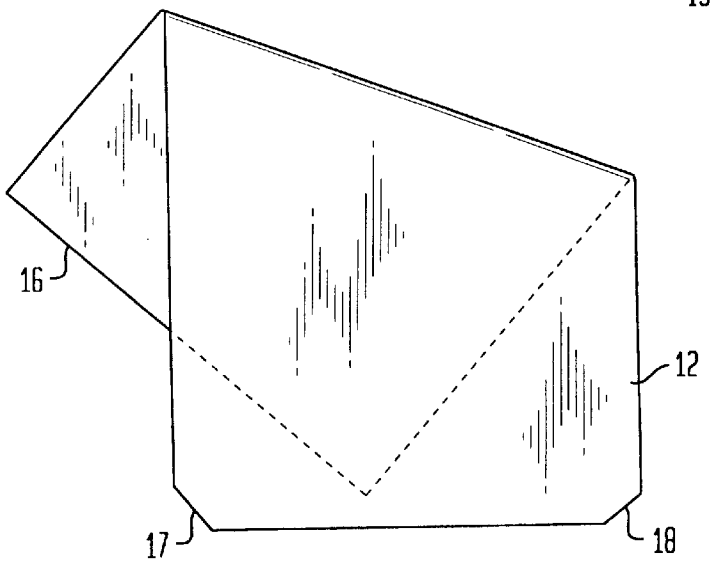
FIG. 3 is a side view of the device shown in FIG. 1.
Figure 4:
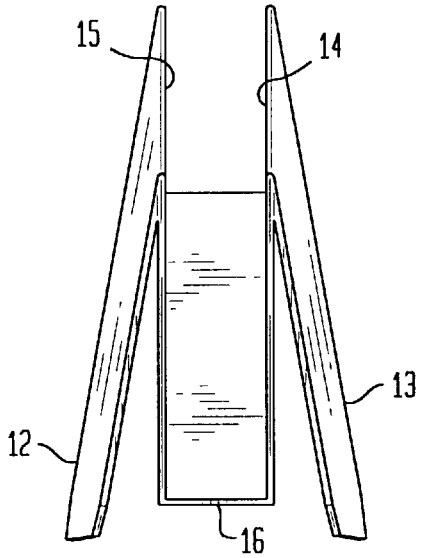
FIG. 4 is a back view of the device of FIG. 1.
Figure 5:
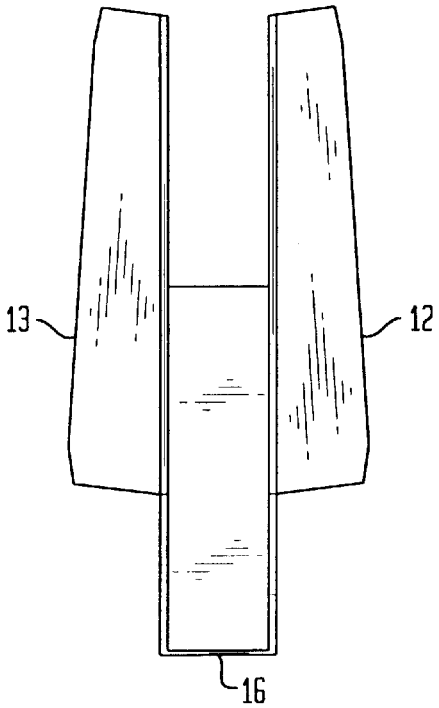
FIG. 5 is a top view of the device of FIG. 1.
Figure 6:
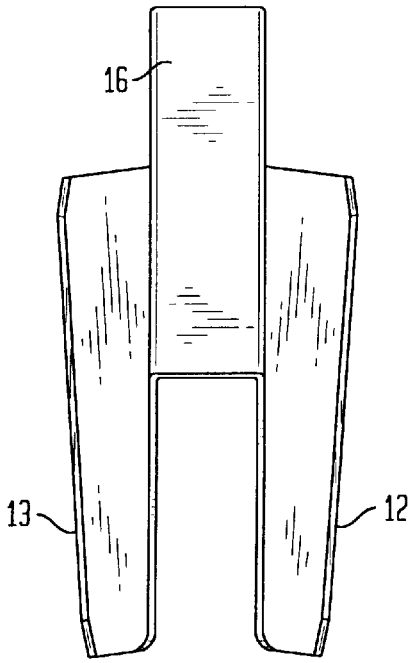
FIG. 6 is a bottom view of the device of FIG. 1.
Figure 7:
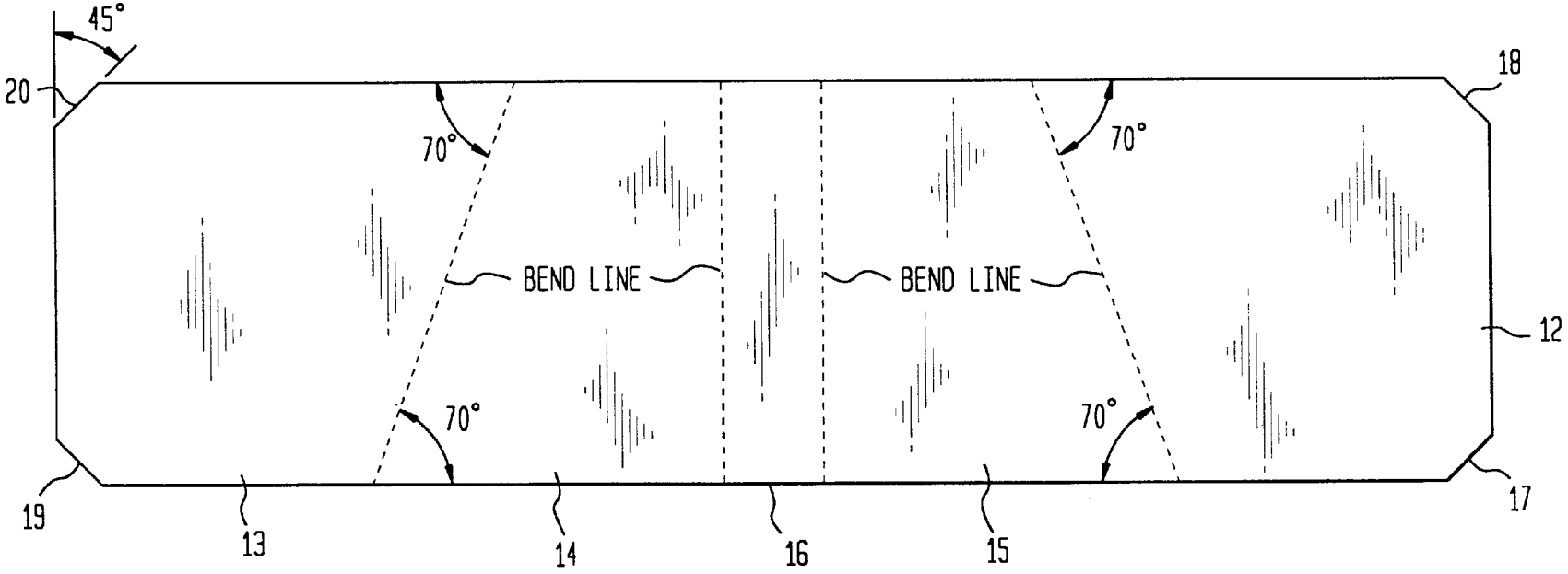
FIG. 7 is a plan view of a unitary material from which the device of FIG. 1 is formed.

As best shown in FIGS. 1 and 3, a support surface 16 at an angle of approximately 40° with respect to the horizontal is formed between walls 14 and 15. These walls, 14 and 15 are, in turn formed by bending a single rectangular blank of desired material along bend lines at angles of 70° with respect to the horizontal as shown in FIG. 7. The material of which the invention is formed may be of sufficient flexibility to provide compressive force between the walls 14 and 15 on a garden hose and/or nozzle to hold same in place on the support surface 16.

Further modifications to the apparatus of the invention may be made without departing from the spirit and scope of the invention; accordingly, what is sought to be protected is set forth in the appended claims.

What is claimed is:

1. A hose nozzle support comprising: a unitary structure having two legs for mounting said unitary structure on a base surface, a first wall attached to one of said legs; a second wall attached to the other of said legs; an angled support surface attached to each of said walls; said angled support surface being formed at an angle of approximately 40° with respect to said base surface, said legs and said walls intersecting at an angle of approximately 30°, said walls being formed of a material capable of exerting compressive force on objects mounted on said angled support surface.

2. A hose nozzle support comprising: a unitary structure having two legs extending generally at an angle of approximately 60° with respect to a surface, a first wall attached to one of said legs; a second wall attached to the other of said legs; said first and second walls extending downwardly towards said surface and an angle of about 30° with respect to said legs; support means attached to each of said walls for supporting a hose nozzle thereon, said support means being formed at an acute angle with respect to said surface.

3. The hose nozzle support of claim 2 wherein said acute angle is approximately 40°.

4. The hose nozzle support of claim 3 wherein said walls are formed of a material capable of exerting compressive force on objects mounted on said support means.

5. A hose nozzle support comprising: a unitary structure having two legs each of said legs having an upper end; a first wall attached to the upper end of one of said legs; a second wall attached to the upper end of the other of said legs; a base connected between each of said walls, said walls and said base forming a support for a hose nozzle, said base being formed at an acute angle with respect to a surface.

6. The hose nozzle support of claim 5 wherein said legs are formed at an acute angle with respect to said surface.

7. The hose nozzle support of claim 6 wherein said walls extend downwardly towards said surface from said upper ends at an angle of about 30° with respect to said legs.

8. The hose nozzle support of claim 7 wherein said base is formed at an acute angle with respect to said surface.

9. The hose nozzle support of claim 6 wherein said acute angle is approximately 60°.

* * * * *